US010068724B2

(12) United States Patent
Lagorgette et al.

(10) Patent No.: US 10,068,724 B2
(45) Date of Patent: Sep. 4, 2018

(54) PUSH-BUTTON ARRANGEMENT FOR AN ELECTRONIC OR ELECTROMECHANICAL WRISTWATCH

(71) Applicant: ETA SA Manufacture Horlogere Suisse, Grenchen (CH)

(72) Inventors: Pascal Lagorgette, Bienne (CH); Raphael Balmer, Vicques (CH)

(73) Assignee: ETA SA Manufacture Horlogere Suisse, Grenchen (CH)

( * ) Notice: Subject to any disclaimer, the term of this patent is extended or adjusted under 35 U.S.C. 154(b) by 0 days.

(21) Appl. No.: 15/284,902

(22) Filed: Oct. 4, 2016

(65) Prior Publication Data

US 2017/0178834 A1 Jun. 22, 2017

(30) Foreign Application Priority Data

Dec. 21, 2015 (EP) ..... 15201722

(51) Int. Cl.
*H01H 13/52* (2006.01)
*H01H 13/14* (2006.01)
*G04C 3/00* (2006.01)

(52) U.S. Cl.
CPC ..... *H01H 13/14* (2013.01); *G04C 3/007* (2013.01); *H01H 13/52* (2013.01)

(58) Field of Classification Search
CPC .. H01H 13/10; H01H 13/702; H01H 2207/03; H01H 2215/004; H01H 2239/006; H01H 2003/0293; H01H 2225/03
USPC ..... 200/512–517, 600, 292, 272
See application file for complete search history.

(56) References Cited

U.S. PATENT DOCUMENTS 3,898,421 A 8/1975 Suzumura
3,911,234 A * 10/1975 Kotaka ..... G06F 15/02 174/254
5,043,958 A 8/1991 Kaelin
2005/0073806 A1 4/2005 Oesch et al.

FOREIGN PATENT DOCUMENTS

EP 0 392 307 A1 10/1990
EP 1 519 453 A1 3/2005
EP 1 566 129 A2 8/2005
FR 2 196 515 3/1974

OTHER PUBLICATIONS

European Search Report dated Jun. 16, 2016 in European Application 15201722, filed on Dec. 21, 2015 ( with English Translation of categories of Cited Documents).

* cited by examiner

*Primary Examiner* — Ahmed Saeed
(74) *Attorney, Agent, or Firm* — Oblon, McClelland, Maier & Neustadt, L.L.P.

(57) ABSTRACT

A push-button arrangement includes an electronic plate. The push-button is of the type surface mounted on a flexible printed circuit sheet that is itself partially fixed to the electronic plate. A portion of the flexible printed circuit sheet that carries the push-button remains free and is folded around a peripheral edge of the electronic plate, such that the push-button extends substantially perpendicularly to the electronic plate and bears against a lateral surface of the electronic plate.

4 Claims, 1 Drawing Sheet

PUSH-BUTTON ARRANGEMENT FOR AN ELECTRONIC OR ELECTROMECHANICAL WRISTWATCH

FIELD OF THE INVENTION

The present invention concerns a push-button arrangement for an electronic wristwatch. More particularly, the invention concerns such a push-button arrangement which is more compact and which has better fatigue resistance.

BACKGROUND OF THE INVENTION

A push-button is a very simple control means which consists schematically of a stem sliding in a passage through the frame of a device, while being held in a rest position by elastic means which push the head of the stem outwards, and being moved into the operating position by the user pressing on the head. The elastic means are, for example, formed by a helical spring housed inside the through passage and which is supported between the frame and the push-button head.

In applications where it is easy for the user to see whether a device is operating properly, such as lighting a chamber or activating a sound source, a control means of the aforementioned type may be satisfactory, even in its simplest form. In other cases, however, it is necessary for the user who presses on a push-button to feel certain that the selected function has actually been activated, in particular when he is not in a position to perform a visual or auditory check. This is particularly so in a chronograph watch, regardless of whether it is mechanical or electronic. Indeed, the command to start/stop timing by pressing on an appropriate push-button must be synchronized with an event, for example a sporting event, that the user has to watch, which means that he cannot simultaneously visually check that the chronograph is operating properly.

To overcome this drawback, various devices have been proposed for producing a click that can be felt by the user when he presses on a push-button. Purely by way of example, the elastic means that are used to hold the push-button at rest may consist of an elastic strip, whose first free end is fixed on a plate and whose second free end, used to hold the push-button in a rest position, is extended by a curved U-shaped portion substantially in the axis of the push-button. This curved portion, which is also elastic, bears against a stud pressed into the plate and, at the end thereof, presents a thickened portion or a notch which, as it passes over the stud, produces a click when the push-button is pressed.

Depending on whether the chronograph watch is mechanical or electronic, activating the push-button will cause a timer mechanism to start or will cause an electrical contact to close just after the click is felt. The drawback of such a push-button arrangement lies, however, in its size, which is relatively large given that the elastic strip extends into a plane and must be sufficiently long to be able to transmit the force applied by the user on the push-button while remaining elastic.

The present invention concerns a second type of so-called surface mount push-button also known as a surface mounted device or SMD. The actuator element of this type of push-button typically consists of a dome-shaped flexible metal sheet, the dome presenting a periphery that bears on a first contact and a peak which, when the user presses on the push-button, deforms and bears on a second contact, which closes an electrical contact and sends an electrical control signal. When pressure is applied to the push-button, the dome changes from its rest position to a pressed-in position, producing a click which is felt by the user. One of the advantages of surface mount push-buttons is that they occupy less space and can therefore be incorporated in devices of small dimensions.

It will be understood, however, on examining FIG. 1 annexed to the present Patent Application, that when such a push-button 1 is mounted on an electronic plate 2 housed inside the case 4 of a portable object, such as an electronic or electromechanical wristwatch, it is often actuated through the side of case 4, i.e. along a radial line therefrom. However, as is noted in FIG. 1, the substantially L-shaped support 6 for push-button 1, is mounted in a cantilever fashion via one of its branches 6*a* on the upper surface 8 of electronic plate 2 by means of a few weld spots 10. Depending on how good the quality of weld spots 10 is, the second branch 6*b* almost inevitably has a slight play 12 with side surface 14 of electronic plate 2, so that under the effect of shear forces due to repeated applications of pressure on push-button 1, there is a high risk of weld points 10 yielding due to fatigue.

SUMMARY OF THE INVENTION

It is an object of the present invention to overcome the aforementioned drawbacks, in addition to others, by providing a push-button arrangement for a portable object of small dimensions, such as an electronic or electromechanical wristwatch, which occupies little space and which is resistant to mechanical fatigue.

To this end, the present invention concerns a push-button arrangement for a portable object consisting of a case inside which is housed an electronic plate, which extends horizontally, the push-button being of the surface mount type with a flexible printed circuit sheet which is itself partially fixed to the electronic plate, the flexible printed circuit sheet being folded around the edge of the electronic plate such that the push-button extends substantially perpendicularly to the electronic plate, bearing against the side thereof.

As a result of these features, the present invention provides a surface mount push-button arrangement that is much more compact than a push-button of the horological type and therefore easier to incorporate in a portable object of small dimensions, such as a wristwatch. Moreover, surface mount push-buttons are standard components produced in large quantities and therefore less expensive. Further, the printed circuit sheet, on which the push-button is welded, extends underneath the latter. Consequently, when the push-button is pressed, the welds are subjected to compression and not shear stress, such that the risk of the welds yielding is almost totally removed. It will also be noted that, since the push-button is bearing against the side of the electronic plate, this provides good mechanical resistance to pressure and allows good positioning tolerances to be obtained in the vertical plane. Finally, as the push-button can be welded flat on the printed circuit sheet, this considerably facilitates manufacturing operations.

According to a complementary feature of the invention, the push-button is disposed in a housing arranged inside the electronic plate, this housing limiting the displacement of the push-button horizontally forwards and backwards, and vertically downwards.

According to another feature of the invention, the housing arranged in the electronic plate is covered by an additional plate which limits the displacement of the push-button vertically upwards.

According to yet another feature of the invention, the case of the portable object is pierced with a through hole inside which slides an external push-button stem, held in a rest position by elastic means that push the stem outwards, and moved into an operating position in which it presses on the surface mount push-button by an application of pressure on the stem.

BRIEF DESCRIPTION OF THE DRAWINGS

Other features and advantages of the present invention will appear more clearly from the following detailed description of an example embodiment of a push-button arrangement according to the invention, this example being given solely by way of non-limiting illustration with reference to the annexed drawing, in which.

DETAILED DESCRIPTION OF ONE EMBODIMENT OF THE INVENTION

The present invention proceeds from the general inventive idea consisting in fixing a surface mount push-button onto a flexible printed circuit sheet, which is itself partly fixed to an electronic plate housed inside the case of a portable object, such as an electronic or electromechanical wristwatch. The printed circuit sheet is arranged on the electronic plate such that the portion of the printed circuit sheet that carries the push-button remains free and can be folded around the edge of the electronic plate to move the push-button into a vertical plane in which the push-button bears against the side of the electronic plate.

Figure 1:
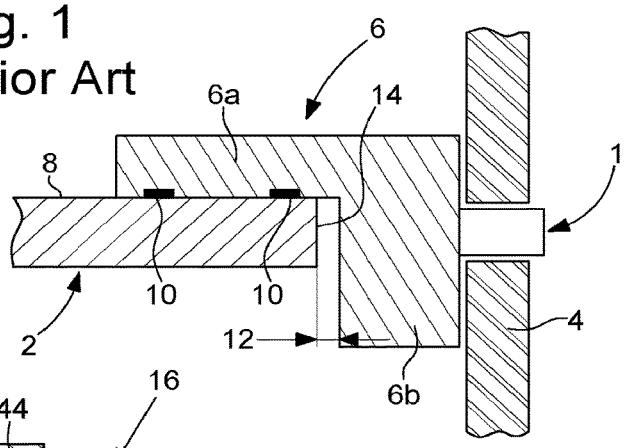
Fig. 1 Prior Art
FIG. 1, cited above, illustrates a push-button arrangement surface mounted on an electronic plate according to the prior art.
Figure 2:
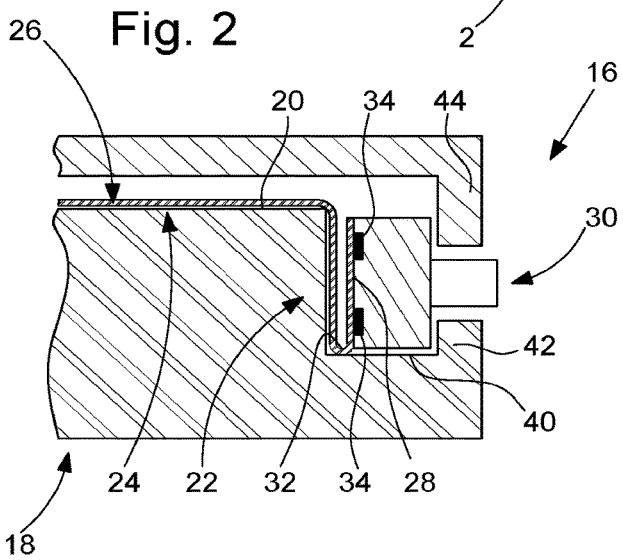
FIG. 2 is a vertical cross-sectional view of an electronic plate on which a flexible printed circuit sheet is fixed, a portion of the flexible printed circuit sheet being left free and carrying a push-button and being folded such that the push-button extends vertically, bearing against the side of the plate.

A push-button arrangement according to the invention is illustrated in FIG. 2, annexed to this Patent Application. Designated as a whole by the general reference numeral 16, this push-button arrangement comprises an electronic plate 18 delimited by a peripheral edge 20 and a lateral surface or side 22. Such an electronic plate 18 is intended to receive on its upper surface 24 a set of electronic components connected to each other by electrically conductive paths and required for the operation of a portable object, such as a wristwatch, in which electronic plate 18 is incorporated.

As revealed by an examination of FIG. 2, a flexible printed circuit sheet 26 is partly fixed to the upper surface 24 of electronic plate 18, whereas the portion 28 of flexible printed circuit sheet 26 that carries a surface mount push-button 30 remains free. The free portion 28 of flexible printed circuit sheet 26 is folded around the peripheral edge 20 of electronic plate 18, such that push-button 30 is in a vertical plane bearing against the side 22 of electronic plate 18. As can be seen in FIG. 2, the free portion 28 of flexible printed circuit sheet 26 that carries push-button 30 is sufficiently long to be able to be folded downwards around peripheral edge 20 of electronic plate 18, then upwards to form a V-shaped fold 32. It goes without saying, however, that this embodiment is given purely by way of non-limiting illustration and that free portion 28 of flexible printed circuit sheet 26 need only be sufficiently long to be folded downwards around peripheral edge 20 of electronic plate 18 and to bring push-button 30 into a vertical plane in which it presses against the side 22 of electronic plate 18.

According to an advantage of the invention, push-button 30 is welded flat onto flexible printed circuit sheet 26. Consequently, when flexible printed circuit sheet 26 is fixed to upper surface 24 of electronic plate 18 and then folded downwards to place push-button 30 in a vertical plane bearing against side 22 of electronic plate 18, the welds 34 via which push-button 30 is secured to flexible printed circuit sheet 26 are subjected to compression and not shear stress when push-button 30 is pressed, such that the risk of these welds 34 yielding is almost totally removed. It will also be noted that, since push-button 30 is bearing against side 22 of electronic plate 18, this provides good mechanical resistance to pressure and allows good positioning tolerances to be obtained in the vertical plane. Finally, as push-button 30 can be flat welded onto flexible printed circuit sheet 26, this considerably facilitates manufacturing operations.

Figure 3:
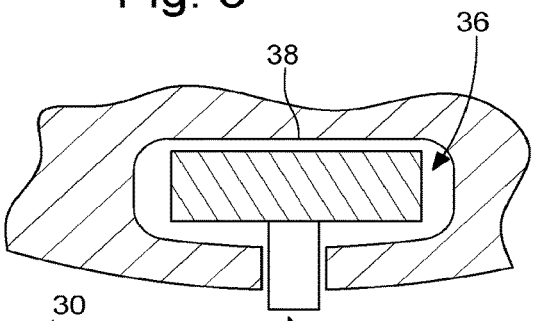
FIG. 3 is a top view of the electronic plate on which is fixed the flexible printed circuit sheet, wherein the additional plate that covers the housing in which the push-button is disposed has been removed.

A careful examination of FIGS. 2 and 3 also reveals that preferably, but not limitatively, push-button 30 is disposed inside a housing 36 arranged in lateral surface 22 of electronic plate 18. This housing 36 is delimited by a vertical side wall 38 which surrounds push-button 30 and which is forwardly extended by a horizontal surface 40. This horizontal surface 40, delimited by an edge portion 42, acts as a bearing surface for push-button 30. Housing 36 thus limits the displacement of push-button 30 horizontally forwards and backwards, and vertically downwards.

Additionally, it is possible (see FIG. 2) to cover housing 36 with an additional plate 44, such that the displacement of push-button 30 is also limited upwards.

Figure 4:
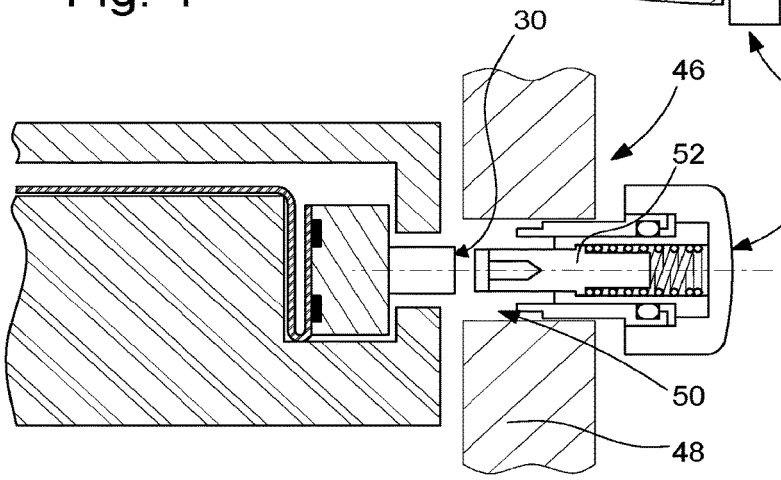
FIG. 4 is a vertical cross-sectional view of the electronic plate illustrated in FIG. 2, this electronic plate being housed inside the case of a portable object which is pierced with a through hole inside which a stem of an external push-button is arranged to slide between a rest position and an operating position in which it presses on the surface mount push-button.

As represented in FIG. 4, the push-button arrangement 16 according to the invention is intended to be housed inside a case 46 of a portable object, such as a wristwatch. This case 46 includes a case middle 48 which is pierced with a through hole 50, inside which a stem 52 of an external push-button 54 is arranged to slide between a rest position, in which stem 52 is held by elastic means 56 which push it outwards, and an operating position in which, by pressure on stem 52, the latter presses on push-button 30.

It goes without saying that this invention is not limited to the embodiment that has just been described and that various simple modifications and variants can be envisaged by those skilled in the art without departing from the scope of the invention as defined by the annexed claims.

NOMENCLATURE

Push-button 1
Electronic plate 2
Case 4
Support 6
Branches 6*a*, 6*b*
Upper surface 8
Weld spots 10

Play 12
Lateral surface 14
Push-button arrangement 16
Electronic plate 18
Peripheral edge 20
Lateral surface or side 22
Upper surface 24
Flexible printed circuit sheet 26
Free portion 28
Push-button 30
V-shaped fold 32
Welds 34
Housing 36
Vertical side wall 38
Horizontal surface 40
Edge portion 42
Additional plate 44
Case 46
Case middle 48
Through hole 50
Stem 52
External push-button 54
Elastic means 56

What is claimed is:

1. A push-button arrangement comprising:

an electronic plate;

a flexible printed circuit sheet partially fixed to the electronic plate; and a push-button welded flat on a surface of a free portion of the flexible printed circuit sheet, wherein the free portion of the flexible printed circuit sheet is not fixed to the electronic plate, and wherein the free portion of the flexible printed circuit sheet extends around a peripheral edge of the electronic plate, such that the push-button is placed in a vertical plane, substantially perpendicularly to the electronic plate and bears against a lateral surface of the electronic plate.

2. The push-button arrangement according to claim 1, wherein the push-button is disposed in a housing arranged in the electronic plate, and wherein the housing limits a displacement of the push-button horizontally forwards and backwards, and vertically downwards.

3. A portable object comprising:

a case which is housing the push-button arrangement according to claim 1, wherein the case of the portable object is pierced with a through hole inside which slides a stem of an external push-button, wherein the stem is held in a rest position by an elastic device that pushes the stem outwards, and wherein the stem is moved into an operating position in which the stem presses on the surface mount push-button by pressure applied to the stem.

4. A push-button arrangement comprising:

an electronic plate;

a flexible printed circuit sheet, partially fixed to the electronic place; and a push-button mounted to a surface of the flexible printed circuit sheet is disposed in a housing arranged in the electronic plate, wherein the housing limits a displacement of the push-button horizontally forwards and backwards, and vertically downwards, wherein the housing is covered by an additional plate that limits the displacement of the push-button vertically upwards, and wherein a free portion of the flexible printed circuit sheet where the push-button is mounted is folded around a peripheral edge of the electronic plate, such that the push-button extends substantially perpendicularly to the electronic plate and bears against a lateral surface of the electronic plate.

* * * * *